United States Patent [19]

Scheinecker et al.

[11] 4,076,069

[45] Feb. 28, 1978

[54] STRAND GUIDE TO BE USED IN A CONTINUOUS CASTING PLANT

[75] Inventors: Alois Scheinecker; Werner Scheurecker, both of Linz, Austria

[73] Assignee: Vereinigte Osterreichische Eisen- und Stahlwerke-Alpine Montan Aktiengesellschaft, Austria

[21] Appl. No.: 732,934

[22] Filed: Oct. 15, 1976

[30] Foreign Application Priority Data

Oct. 29, 1975 Austria ..... 8217/75

[51] Int. Cl.[2] ..... B22D 11/12

[52] U.S. Cl. ..... 164/448; 72/248; 193/35 R

[58] Field of Search ..... 164/273 R, 282; 193/35 R; 72/227, 246, 243, 248; 198/202, 167; 226/189

[56] References Cited

U.S. PATENT DOCUMENTS 4,007,822 2/1977 Scheurecker ..... 164/282 X

*Primary Examiner*—Robert L. Spicer, Jr.

*Attorney, Agent, or Firm*—Brumbaugh, Graves, Donohue & Raymond

[57] ABSTRACT

A strand guide for a continuous casting plant has oppositely arranged frame parts connected by drawing anchors and at least one of the frame parts is displaceable along the drawing anchors and fixable thereon. Two bushings with helical supporting faces are provided on each drawing anchor and rotatable therearound, and are fixed abutments are provided on each drawing anchor to countersupport the rotatable bushings. The displaceable frame part is guided on each drawing anchor between the two rotatable bushings.

10 Claims, 6 Drawing Figures

STRAND GUIDE TO BE USED IN A CONTINUOUS CASTING PLANT

BACKGROUND OF THE INVENTION

The invention relates to a strand guide in a continuous casting plant having opposite frame or stand parts connected by drawing anchors, in which frame or stand parts strand guiding rollers are journaled. At least one of the frame or stand parts is displaceable along the drawing anchors and is fixable thereon.

In continuous casting plants, in particular in continiuous casting plants for slabs, it ought to be possible to cast strands of different dimensions. Therefore it is necessary for the distance between the rollers supporting the strand at opposite sides to be adjustable to the desired strand thickness.

A known strand guide (German Offenlegungsschrift No. 2,062,792) has a ring provided with catches at the end of each drawing anchor, which catches are directed to steps of a stepped ring resting on the adjustable frame part. Perpendicular to the strand surface there are provided pressure medium cylinders for adjusting the frame part. For adjusting a certain roller distance it is necessary to lift the stand part which is displaceable along the drawing anchors, to place the stepped ring into the desired position, to adjust the frame part to the stepped ring up to the stop and then to keep it in this position.

In another known strand guide (German Pat. No. 1,963,146) the adjustment of the frame parts to the preselected roller distance is effected by spacers having a plurality of supporting faces at various heights for oppositely arranged bearing faces on the adjustable stand part. If the roller distance is to be changed, with this arrangement it is aldo necessary to lift the adjustable stand part, to put the spacers into the correct position, to place the stannd part upon the spacer and then to maintain it in this position.

In these known strand guides separate pressure medium cylinders are required for moving and holding the stand parts, which cylinders have to accommodate the entire load due to the ferrostatic pressure and the entire weight of the adjustable strand guide part. A further disadvantage of these known strand guides consists in that it is not possible to infinitely variably adjust the roller distance. Only those roller distances corresponding to the steps of the stepped ring or the spacers can be achieved.

SUMMARY OF THE INVENTION

The invention aims at preventing these disadvantages and difficulties and has as its object to create a strand guide, wherein the roller distance can be adjusted to any desired magnitude in an easy manner without the exchange of spacers. The stability required for a strand guide is also to be safeguarded.

According to the invention this object is achieved in that the displaceable frame or stand part is guided on each drawing anchor between two bushings which are rotatable around the drawing anchor and have helical supporting faces. The bushings are countersupported by fixed abutments of the drawing anchor. By a simultaneous rotation of both bushings on each drawing anchor the adjustable stand part is displaced along the drawing anchors. If only one of the two bushings is rotated, the stand part, depending on the direction of rotation, will either be clamped or be freely movable along the drawing anchors. Thus the rollers can be brought out of engagement with the strand and freed from the load applied by the strand.

According to a preferred embodiment of the invention two bushings are provided, which bushings are helical supporting faces of opposite ascent at both ends. The frame or stand part is being guided between them on sliding elements. This has the result that twice the displacement path is achieved for the adjustable stand part, as compared to bushings having only one helical supporting face, when rotating the bushings by the same angle.

Advantageously, bushings having a counter sliding face corresponding to the helical supporting face of the rotatable bushing and forming a thread therewith are rigidly secured to the frame or stand part.

Suitably each rotatable bushing is supported relative to the drawing anchor via a bushing that is rigidly connected to the drawing anchor and has a counter sliding face corresponding to the helical face of the rotatable bushing and forms a thread therewith.

For rotating the bushings, suitably pressure medium cylinders are provided with are each articulated to the rotatable bushing and to the displaceable frame or stand part.

An advantageous embodiment is characterized in that the helical faces of the bushings are provided with an angle of ascent that is smaller than the pertaining angle of friction. Thus during the casting operation it is not necessary to actuate the pressure medium cylinders provided for rotating the bushings.

BRIEF DESCRIPTION OF THE DRAWINGS

The invention shall now be described by way of a number of embodiments and with reference to the accompanying drawings, wherein.

DESCRIPTION OF EXEMPLARY EMBODIMENTS

Figure 1:
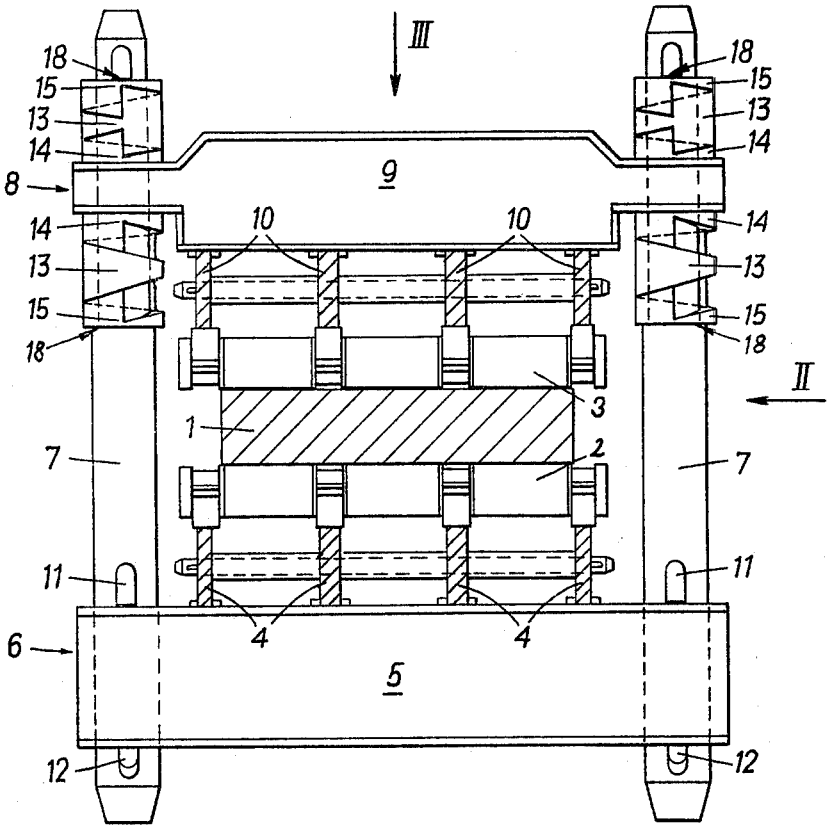
FIG. 1 is a section through the strand guide transverse to the direction of the longitudinal axis of the strand.
Figure 3:
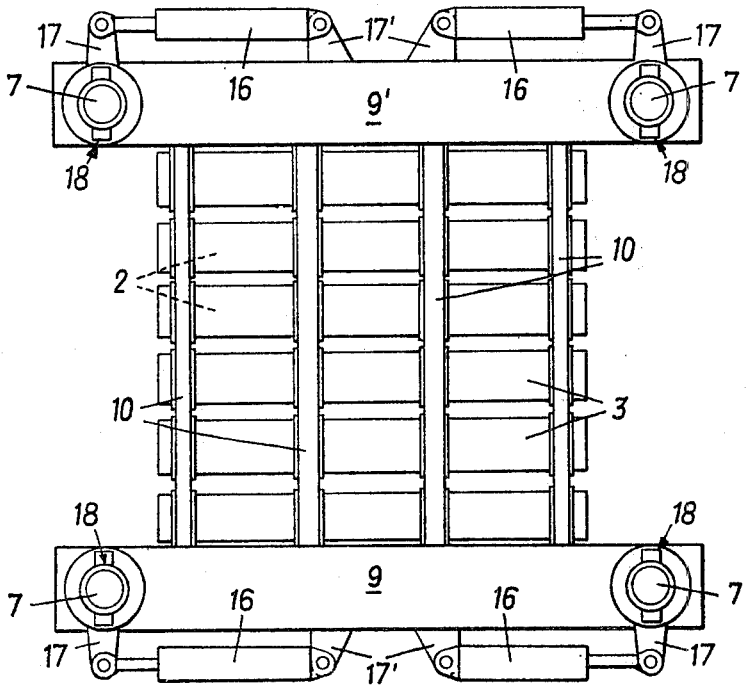
FIG. 3 is a view in the direction of the arrow III of FIG. 1, and FIGS. 4*a*, 4*b* and 4*c* are schematic illustrations of further possible embodiments and arrangements of the bushings having helical supporting faces.
Figure 2:
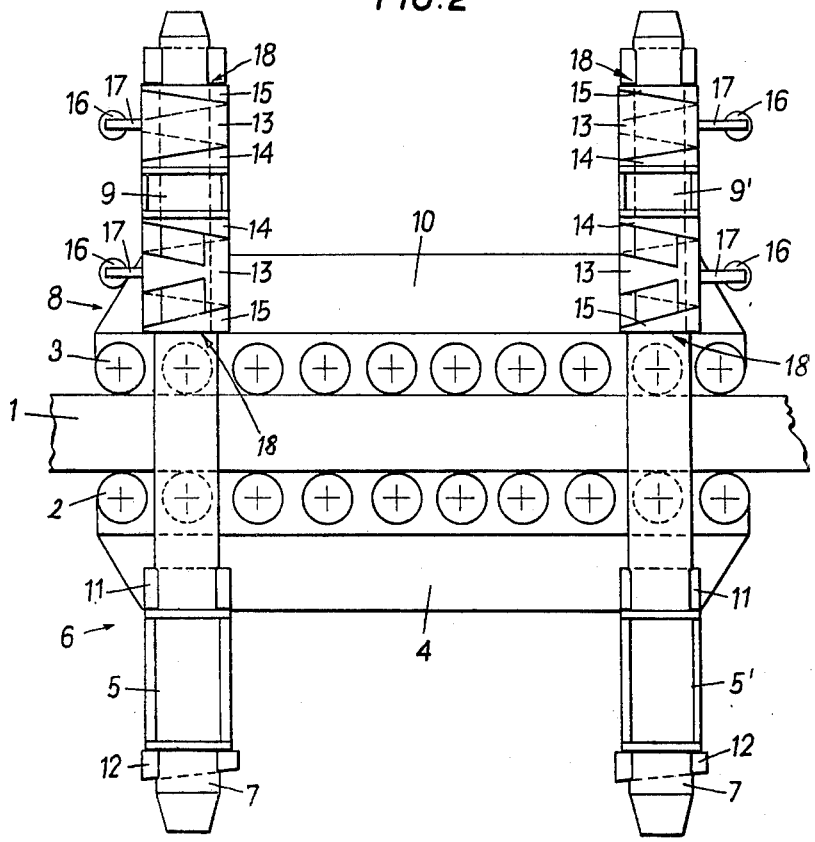
FIG. 2 is a view in the direction of the arrow II of FIG. 1.

By 1 a strand is denoted, which strand is guided and supported between opposing strand guide rollers 2 and 3. The strand guide rollers 2 supporting the strand at its outer or lower side are journaled via longitudinal carriers 4 on two transverse carriers 5 and 5' supported on the base. This rigid stand part 6 formed by the transverse carriers and the longitudinal carriers secured thereto, is opposed by a stand part 8 displaceable along drawing anchors 7, which oppositely arranged stand part is formed by the transverse carriers 9 and 9' and the longitudinal carriers 10 carrying the rollers 3. The drawing anchors are secured to the ends of the transverse carriers 5 and 5' by means of inserts 11 and wedges 12. The stand part 8 is guided on each drawing anchor 7 between two bushings 13 slipped onto the drawing anchor and journaled to be rotatable therearound, which bushings are provided at both ends with helical supporting faces having opposite ascent. The bushings 13 are each supported against the stand part 8 via slidings elements, such as bushings 14, ridigly secured thereto and having a counter sliding face corresponding to he helical supporting face of the rotatable bushing 13. With their other ends the bushings 13 are supported on other sliding elements, such as bushings 15, rigidly secured to abutments 18 of the drawing anchors 7. Each one of the rigid bushings 15 is also provided with a counter sliding face corresponding to the helical face of the rotatable bushing 13. For actuating the rotatable bushings 13, one pressure medium cylinder 16 is provided per bushing, whose piston rod is articulated to a leverlike flange 17 of the bushing 13. The pressure medium cylinder 16 is journaled on a console 17' secured to the transverse carrier, 9 and 9'.

For adjusting a predetermined roller distance at first the bushing 13 arranged outside of the two stand parts 6 and 8 is rotated on each drawing anchor 7 until the stand part 8 is freely movable along the drawing anchor 7. Then the stand part 8 can be adjusted to a predetermined roller distance by corresponding rotation of the bushings 13 arranged between the stand parts 6 and 8. By rotating the outwardly arranged bushings 13 the stand part 8 can then be fixed in its new position.

The force to be applied for holding and displacing the stand part 8 is diminished corresponding to the ascent of the helical supporting faces. If the ascent is less than the pertaining angle of friction, the arrangement is self-locking and the pressure medium cylinder 16 need not be actuated for fixing the stand part 8.

Advantageously, inductive distance measuring devices are provided for an exact adjustment of a predetermined roller distance.

When the strand gets stuck or when other disturbances of the casting operation occur, the bushings make it possible to free the adjustable fame part of the whole plant within the shortest possible time. To accomplish it is only necessary to simultaneously actuate the pressure medium cylinders 16 arranged outside the stand parts 6 and 8. This greatly reduces the danger of damage to the strand guiding rollers.

Figure 4A:
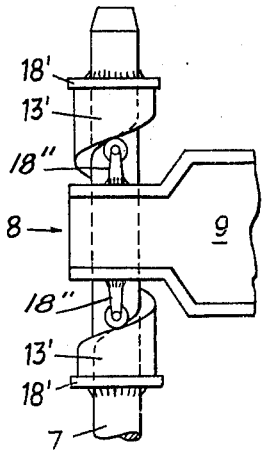
Figure 4B:
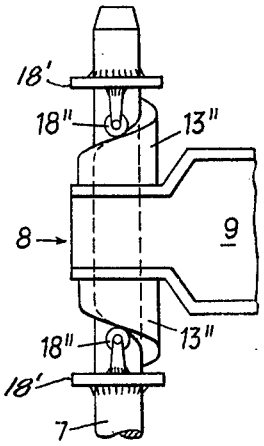
Figure 4C:
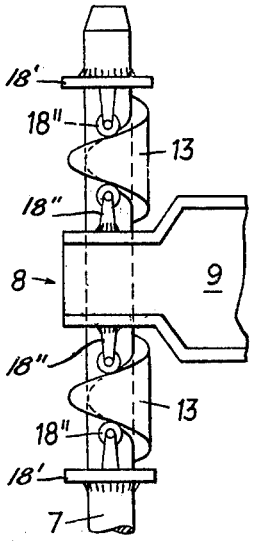

FIGS. 4*a* to 4*c* schematically illustrate further possible embodiments and arrangements of the rotatable bushings. In FIG. 4*a* the rotatable bushings 13' are provided with helical supporting faces only on the side allocated to the adjustable stand part 8 and are supported on a disc-shaped abutment 18'; sliding elements 18'' in the form of rollers mounted on the strand part 8 bring about the movement of the strand part upon rotation of bushings 13'. In FIG. 4b the rotatable bushings 13'' are supported on the strand part 8 with their helical supporting faces on the side facing the abutments 18' of the drawing anchors and formed by the rollers of sliding elements 18'' which are secured to the drawing anchors and roll on the helical faces. In FIG. 4c the bushing 13, which has helical supporting faces of opposite ascent at both ends, is illustrated in a simplified manner.

With long strand guiding paths, such as are necessary in rapid continuous casting plants, either a number of the strand guides illustrated in the drawings can be arranged one behind the other, or continuous longitudinal carriers extending over the entire longitudinal extension of the strand guiding path can be used, which continuous longitudinal carriers are journaled on a plurality of transverse carriers. With the continuous longitudinal carriers the rotatable bushings are provided at each one of the drawing anchors connecting oppositely arranged transverse carriers. In particular, strand guides, in which the rollers are journaled on arcuate longitudinal carriers, can be equipped with the bushings 13, 14 and 15 according to the invention.

We claim:

1. In a strand guide to be used in a continuous casting plant and having oppositely arranged frame parts, drawing anchors connecting the frame parts and strand guiding rollers journaled in the frame parts, at least one of the frame parts being a displaceable frame part which is movable along the drawing anchors and fixable thereon, the improvement comprising:

two rotatable bushings having helical supporting faces provided on each drawing anchor and rotatable therearound, the displaceable frame part being located on said drawing anchors between said two rotatable bushings;

two fixed abutments provided on each drawing anchor on opposite sides of the displaceable frame part, the fixed abutments securing the two rotatable bushings on each drawing anchor; and sliding elements provided on opposite sides of the displaceable frame part on each drawing anchor for contacting the helical supporting faces of the rotatable bushings and translating the rotary motion of the rotatable bushings into a displacement of the displaceable frame part on each drawing anchor.

2. A strand guide as set forth in claim 1, wherein each of the two rotatable bushings has helical supporting faces with opposite ascent at each end thereof and the sliding elements are provided on both fixed abutments and on both sides of the displaceable frame part on each drawing anchor so as to guide the displaceable frame part on the drawing anchor.

3. A strand guide as set forth in claim 1, wherein the sliding elements comprise additional bushings rigidly secured to the displaceable frame part, which additional bushings are provided with counter sliding faces corresponding to the helical supporting faces of the two rotatable bushings.

4. A strand guide as set forth in claim 1, wherein the sliding elements comprise an additional bushing for each rotatable bushing, which additional bushing is rigidly connected to the pertaining drawing anchor, and has a counter sliding face corresponding to the helical supporting face of the pertaining rotatable bushing, each rotatable bushing being supported via said additional bushing.

5. A strand guide as set forth in claim 1, further comprising pressure medium cylinder means articulated to each rotatable bushing and to the displaceable frame part for actuation of each rotatable bushing.

6. A strand guide as set forth in claim 1, wherein the helical supporting faces of the rotatable bushings have an angle of ascent that is smaller than the pertaining angle of friction.

7. A strand guide as set forth in claim 2 wherein the sliding elements comprise a first set of additional bushings rigidly secured to both sides of the displaceable frame part on each drawing anchor and a second set of additional bushings rigidly secured to the two fixed abutments, said first and second sets of bushings having counter sliding faces corresponding to and contacting the respective helical supporting faces of opposite ascent of the two rotatable bushings.

8. A strand guide as set forth in claim 1 wherein the sliding elements comprise rollers secured to the displaceable frame part, the helical supporting faces of the rotatable bushings being arranged so as to contact the rollers.

9. A strand guide as set forth in claim 1 wherein the sliding elements comprise rollers secured to the fixed abutments, the helical supporting surfaces of the rotatable bushings being arranged so as to contact the rollers.

10. A strand guide as set forth in claim 2 wherein the sliding elements comprise a first set of rollers secured to both sides of the displaceable frame part on each drawing anchor and a second set of rollers secured to the two fixed abutments, said first and second set of rollers and the respective helical supporting faces of said rotatable bushings being arranged so as to contact each other.

* * * * *